US008205911B2

(12) United States Patent
Cordes et al.

(10) Patent No.: US 8,205,911 B2
(45) Date of Patent: Jun. 26, 2012

(54) TELESCOPING TUBE SYSTEM FOR A VACUUM CLEANER

(75) Inventors: Martin Cordes, Sundern (DE); Stephan Cordes, Arnsberg (DE)

(73) Assignee: Fischer Rohrtechnik GmbH, Achern-Fautenbach (DE)

( * ) Notice: Subject to any disclaimer, the term of this patent is extended or adjusted under 35 U.S.C. 154(b) by 162 days.

(21) Appl. No.: 12/780,063

(22) Filed: May 14, 2010

(65) Prior Publication Data

US 2010/0287726 A1 Nov. 18, 2010

(30) Foreign Application Priority Data

May 15, 2009 (DE) ..... 10 2009 021 596

(51) Int. Cl.
*A47L 9/24* (2006.01)

(52) U.S. Cl. ..... 285/7; 285/302

(58) Field of Classification Search ..... 285/7, 302, 285/303, 298; 15/321, 415.1, 377; 174/47
See application file for complete search history.

(56) References Cited

U.S. PATENT DOCUMENTS 3,314,039 A * 4/1967 Opper ..... 285/7
4,079,965 A * 3/1978 Moughty et al. ..... 285/7
4,494,270 A * 1/1985 Ritzau et al. ..... 15/377
4,618,195 A * 10/1986 Keane ..... 285/7
4,652,063 A * 3/1987 Genoa et al. ..... 439/192
5,685,044 A * 11/1997 Lavis et al. ..... 285/7
5,716,076 A * 2/1998 Tamborini et al. ..... 285/7
5,740,583 A * 4/1998 Shimada et al. ..... 15/377
5,967,563 A * 10/1999 Lavis et al. ..... 285/7
6,148,474 A * 11/2000 Ohara et al. ..... 15/377
6,243,915 B1 * 6/2001 Nakai et al. ..... 174/47
6,486,396 B2 * 11/2002 Stein ..... 174/47
7,883,116 B2 * 2/2011 Canale ..... 285/7
2008/0143097 A1 * 6/2008 Canale ..... 285/7

FOREIGN PATENT DOCUMENTS

DE 196 52 647 C1 12/1997

* cited by examiner

*Primary Examiner* — David E Bochna
(74) *Attorney, Agent, or Firm* — Roberts Mlotkowski Safran & Cole, P.C.; David S. Safran

(57) ABSTRACT

A telescoping tube system for a vacuum cleaner, with an inner jacket tube, an outer jacket tube, an inner suction tube and a cable, the inner jacket tube having a smaller cross section than the outer jacket tube so that the inner jacket tube and the outer jacket tube form a telescoping jacket channel, the inner suction tube being located inside of the jacket channel, and the cable being guided within the jacket channel and outside of the inner suction tube. In the telescoping tube system, losses of suction force by the intake of secondary air are reduced to a minimum and reliable cable routing is ensured by there being an outer suction tube, the outer suction tube and the inner suction tube forming an essentially closed suction channel within the jacket channel.

16 Claims, 5 Drawing Sheets

TELESCOPING TUBE SYSTEM FOR A VACUUM CLEANER

BACKGROUND OF THE INVENTION

1. Field of the Invention

The invention relates to a telescoping tube system for a vacuum cleaner, with an inner jacket tube, an outer jacket tube, an inner suction tube and a cable, the inner jacket tube having a smaller cross section than the outer jacket tube so that the inner jacket tube and the outer jacket tube form a telescoping jacket channel, the inner suction tube being located in the jacket channel, and the cable being guided within the jacket channel and outside the inner suction tube.

2. Description of Related Art

In the prior art telescoping tube systems are known in which the electric cable is guided along the tube system with a closed cable channel within the suction channel. Both the suction channel and also the cable channel can be telescoped and are connected to one another such that they have essentially the same length. The cable channel completely surrounds the cable and protects it against dirt and damage by particles which are being routed through the suction channel. It is a disadvantage in the tube system known from the prior art that the suction channel has a plurality of openings and connecting sites through which secondary air can enter the tube system so that, for example, when using the tube system as a vacuum cleaner tube, the suction force is reduced by the intake of secondary air. Furthermore, the cable channel within the suction channel leads to swirling and thus to non-uniform flow.

SUMMARY OF THE INVENTION

Therefore, a primary object of this invention is to devise a telescoping tube system which reduces the loss of suction force due to the intake of secondary air and which ensures reliable cable routing.

The aforementioned object is achieved in a telescoping tube system of the initially named type by an outer suction tube being provided, the outer suction tube and the inner suction tube forming an essentially closed suction channel within the jacket channel. Within the surrounding jacket channel, completely independently of one another the suction channel runs in which air routing can take place, and the cable runs by which an electrical connection from one end of the jacket channel to the other end of the jacket channel can be produced. The jacket channel is formed by the outer jacket tube and the inner jacket tube and can telescope by the inner jacket tube being movable within the outer jacket tube. For this purpose, the inner jacket tube has a slightly smaller diameter or cross section than the outer jacket tube. The outside diameter or the outside contour of the inner jacket tube corresponds essentially to the inside diameter or the inside contour of the outer jacket tube so that the inner jacket tube is guided within the outer jacket tube with little play. The movement of the inner jacket tube relative to the outer jacket tube or of the outer jacket tube relative to the inner jacket tube makes it possible to adjust the length of the jacket channel at will. The essentially closed suction channel within the jacket channel separates the air guide completely and reliably from the electrical line, the suction channel at the same time having only a small number of connecting sites so that there is only a small risk that secondary air will enter the suction channel So that the cable is separated from the suction channel in the entire jacket channel, it is provided that the length of the suction channel always corresponds essentially to the length of the jacket channel, especially by the inner suction tube being attached to the outer jacket tube and the outer suction tube being attached to the inner jacket tube or vice versa. It is preferably provided that the suction channel can also telescope. The attachment ensures that when the outer jacket tube moves relative to the inner jacket tube, i.e., the length of the jacket channel changes, the length of suction channel is always changed at the same time. The connection of the inner suction tube to the outer jacket tube and of the outer suction tube to the inner jacket tube takes place in the common end regions so that in the area between the two end regions—in the middle region—the jacket channel and the suction channel can telescope.

When using the telescoping tube system on a vacuum cleaner, it is provided that the air flow in the flow direction is not obstructed or swirled by edges, especially by a tube with larger diameter following a tube with a certain diameter in the flow direction; for this exemplary embodiment this means that the outer suction tube follows the inner suction tube in the flow direction.

Furthermore, it is preferably provided that the suction channel has an essentially round cross section and the suction channel especially does not have any projections. A round suction channel enables an essentially uniform flow profile to form. The flow is not swirled by internals or projections so that flow can be approximated to a flow profile which is as uniform as possible with little effort; furthermore, this has the advantage that the suction efficiency is increased and particles are for the most part prevented from becoming jammed or hooked in the suction channel.

The suction channel is comprised of an inner suction tube and an outer suction tube, the inner suction tube being inserted into the outer suction tube to roughly half the length of the suction channel. Any opening within the suction channel leads to the entry of secondary air and has an adverse effect on the suction force since the negative pressure produced by the vacuum cleaner is reduced by the inflowing secondary air. For this reason, neither the inner suction tube nor the outer suction tube consequently has an opening over the path within the jacket channel so that the entry of secondary air into the suction channel is reliably stopped. Openings, interruptions, etc., in this configuration can be eliminated in the suction channel since the mechanical connection of the tube system to other systems takes place essentially via the jacket channel, so that the suction channel acquires almost exclusively the task of flow routing.

According to a preferred configuration of the telescoping tube system, it is provided that, on the end of the inner suction tube facing away from the outer suction tube, there is a first connection element and on the end of the outer suction tube facing away from the inner suction tube there is a second connection element. Thus, on the two ends of the suction channel, and thus, also on the two ends of the jacket channel, there is a connection element which enables connection of the telescoping tube system to other tube systems and/or a hose system. The connection elements are those coupling parts which enable connection of two tubes.

Especially preferably it is provided that the inner suction tube is connected by way of the first connection element to the outer jacket tube and the outer suction tube is connected by way of the second connection element to the inner jacket tube. The connection elements, for example, for this purpose, can be slipped onto or inserted into the ends of the outer suction tube and of the inner suction tube and can be connected positively, non-positively or by bonding to the respective suction tube. The connecting elements, in turn, are connected respectively, non-positively, by bonding, or preferably, positively to the outer jacket tube and the inner jacket tube. This configuration enables simultaneous telescoping of the suction channel and jacket channel since the suction tubes and the jacket tubes are connected on the respective outer ends to one another by way of the connection elements. The connection elements are additionally used to connect the telescoping tube system to other systems.

It has proven to be especially advantageous when the first connection element is made as a socket piece and the second connection element is made as a connecting sleeve, in the mounted state the connecting sleeve being inserted at least partially into the inner jacket tube and the socket piece at least partially into the outer jacket tube. The socket piece as the first connection element and the connecting sleeve as the second connection element constitute counterparts which correspond to one another so that a further socket piece can be inserted in the connecting sleeve and the socket piece can be inserted into a further connecting sleeve. But alternatively it is also provided that the connecting sleeve be intended only for certain socket pieces and the socket piece be intended only for certain connecting sleeves in order for example, to preclude unintentional misconnection of individual systems and to allow only chosen connection possibilities.

Preferably, the socket piece and the connecting sleeve have standardized diameters so that the telescoping tube system can be connected to standardized parts of other systems. The socket piece and the connecting sleeve are connected to the inner suction tube and the outer suction tube. The socket piece in the mounted state is inserted into the outer jacket tube or the connecting sleeve is inserted into the inner jacket tube such that the cross section of the inner jacket tube and or the outer jacket tube is completely filled, by which additional sealing of the jacket channel on its ends takes place and at the same time a connection, for example, positively in the form of a catch projection, of the socket piece to the outer jacket tube and the connecting sleeve to the inner jacket tube is ensured.

According to a preferred configuration, the cable and the suction channel run next to one another within the jacket channel so that separation of the electrical connection and of the suction channel is ensured. Preferably, it is provided that the first end of the cable can be attached to the first connection element and the second end of the cable to the second connection element. When the cable is attached to the ends of the jacket channel or to the ends of the suction channel, preferably to the connection elements, it is always ensured that the cable ends are accessible in the end regions of the jacket channel. The cable accordingly matches its length to the length of the suction channel or jacket channel. For this application, a helical cable has proven especially advantageous since a helical cable makes it possible to equalize very great length differences with a simply configured cable without the cable having to be onerously rolled up or in some other way guided.

It has proven especially advantageous if the cable has a socket on one end and a plug on the other end, especially the plug or the socket can be positively attached to the first connection element or to the second connection element. For this purpose, the connection elements preferably have recesses in the form of the plug or of the socket so that the plug or the socket can be positively inserted into a respective connection element, and thus, can be connected to it. This ensures that to produce an electrical connection on one end of the jacket channel a plug is accessible and on the other end of the jacket channel a socket is accessible. The plug or the socket are integrated into the outside contour of the connection elements such that the connection elements including the plug and the socket can be inserted into the outer jacket tube or the inner jacket tube, at least in part.

The suction channel and the cable run parallel next to one another within the jacket channel so that the jacket channel surrounds both elements. Motion which occurs especially as a result of the telescoping of the jacket channel or of the suction channel could lead to damage of the protective insulation of the cable. So that the free contacts do not connect to the metallic parts when the protective insulation of the cable is damaged, it is preferably provided that there is a shell, and the cable is covered by the shell against the outer jacket tube and the inner jacket tube. This covering ensures that the cable is only in contact with the inner sides of the shell and on the open side of the shell with the suction channel. Contact of the cable with metallic parts is precluded since the suction channel and the shell are preferably made of plastic. Furthermore the shell preferably has a U-shaped or V-shaped cross section.

So that the shell can reliably follow the change in the length of the suction channel and thus also of the cable, the shell comprises at least a first shell element and a second shell element, the first shell element and the second shell element being able to telescope. Preferably, the first end of the shell can be attached to the first connection element and the second end of the shell can be connected to the second connection element. The shell is consequently connected on the two ends of the jacket channel to the connection elements located there so that the shell reliably follows any change in the length of the suction channel or of the jacket channel, at the same time ensures covering of the cable and prevents contact of the cable with metallic parts. The ends of the two-part shell are preferably positively connected to the connection elements, for example, by means of a projection and an offset.

In order to ensure reliable insulation of the cable and good sliding properties of the shell, it is provided that the shell is made of a special plastic, preferably the first shell element consists of PE (polyethylene) and the second shell element of PET (polyethylene terephthalate). The use of plastic which is not electrically conductive for covering the cable offers additional protection against contact of a conductor with metallic parts of the telescoping tube system. The use of PE as a material for the first shell element due to the good sliding properties of PE offers the advantage that the shell can be easily telescoped, and thus, its length can be changed without noticeable adhesive friction opposing the motion.

The entry of secondary air into the suction channel is on the one hand, prevented by the suction channel not having an opening within the jacket channel, on the other hand, by there being preferably a sealing device which has been extended over the periphery on the inner suction tube, preferably there being a sealing lip on the inner suction tube. This sealing lip, which preferably completely surrounds the inner suction tube, completely seals the connection between the inner suction tube and the outer suction tube so that secondary air cannot enter the suction channel at this connecting site. However, at the same time, this seal is able to slide such that the telescoping capacity of the suction channel is not hindered by the seal.

According to the last configuration of the telescoping tube system, it is provided that a spacer is inserted between the outer jacket tube and the inner jacket tube, especially there being an interlocking device on the spacer, and the outer jacket tube can be fixed relative to the inner jacket tube with an interlocking device. The spacer between the outer jacket tube and the inner jacket tube, on the one hand, defines the distance of the inner jacket tube relative to the outer jacket tube, and on the other hand, the spacer performs an additional sealing function. The spacer between the outer jacket tube and the inner jacket tube also prevents jamming of the tubes in one another and ensures a uniform and quiet sliding process of the tubes.

Preferably, there is additionally an interlocking device on the spacer which enables fixing of the outer jacket tube relative to the inner jacket tube. The outer jacket tube can be moved relative to the inner jacket tube, and thus, the length of the jacket channel can be set. The interlocking device can, at this point, permanently fix the position of the outer jacket tube relative to the inner jacket tube so that the length of the jacket channel can be permanently adjusted. The interlocking means is, for example, a catch projection on the interlocking device which can engage one catch recess of a plurality of catch recesses in the inner jacket tube so that a positive connection between the outer jacket tube and the inner jacket tube is accomplished. The inner jacket tube for this purpose preferably has a plurality of catch recesses at regular intervals so that the length of the jacket channel can be incrementally adjusted, depending on the distances between the catch recesses.

The telescoping tube system is preferably suitable for use as a suction tube for a vacuum cleaner, especially because a suction process with minimum loss of suction force is possible by advantageous configurations.

In particular, there is now various possibilities for embodying and developing the telescoping tube system as claimed in the invention. In this regard reference is made to the following description of preferred embodiments in conjunction with the accompanying drawings.

DETAILED DESCRIPTION OF THE INVENTION

Figure 1:
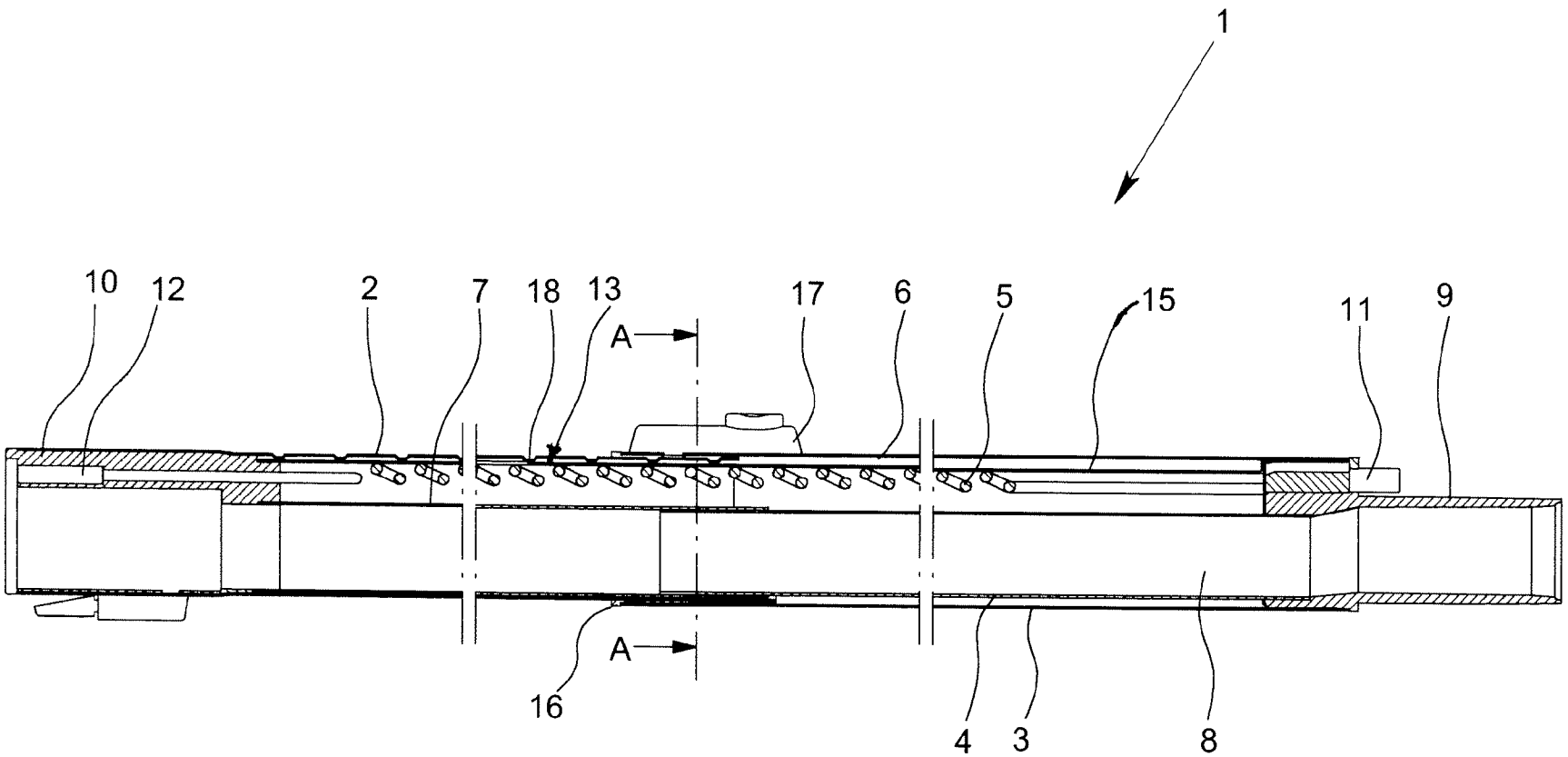
FIG. 1 shows an exemplary embodiment of a telescoping tube system of the invention for a vacuum cleaner in a sectional side view.

FIG. 1 shows a telescoping tube system 1 for a vacuum cleaner, with an inner jacket tube 2, an outer jacket tube 3, an inner suction tube 4 and a cable 5. The inner jacket tube 2 has a smaller cross section than the outer jacket tube 3 so that the inner jacket tube 2 and the outer jacket tube 3 form a telescoping jacket channel 6. The jacket channel 6 surrounds the inner suction tube 4 and the cable 5, the cable 5 being guided inward of the jacket channel 6 and outside the inner suction tube 4. The inner suction tube 4 together with an outer suction tube 7 forms an essentially closed suction channel 8. The suction channel 8 runs off-center with respect to the surrounding jacket channel 6.

Both the jacket channel 6 and also the suction channel 8 can be telescoped with respect to their length since the outer jacket tube 3 can be moved relative to the inner jacket tube 2, and the outer suction tube 7 relative to the inner suction tube 4. In the exemplary embodiment shown in FIG. 1, the length of the suction channel 8 always corresponds essentially to the length of the jacket channel 6 so that, in this way, it is ensured that the outer suction tube 7 is connected at the first end—shown at left in FIG. 1—of the telescoping tube system 1 to the inner jacket tube 2 or is attached to it; on the second end—which is shown at right in FIG. 1—the inner suction tube 4 is attached to the outer jacket tube 3. The attachment of the inner suction tube 4 and of the outer suction tube 7 to the inner jacket tube 2 and to the outer jacket tube 3 ensures that the suction channel 8 is always telescoped with respect to its length simultaneously with the jacket channel 6.

When using the telescoping tube system 1, for example, as the suction tube of a vacuum cleaner, the suction air according to the exemplary embodiment, would flow from right to left through the telescoping tube system 1 as shown in FIG. 1. In order to ensure optimum flow within the suction channel 8, the suction channel 8 is essentially round—see FIG. 5—and in particular, does not have any projections. To avoid projections in the flow direction, the outer suction tube 7 follows the inner suction tube 4, the outer suction tube 7—as already described—having a larger cross section than the inner suction tube 4 so that, in particular, in the transition between the inner suction tube 4 and the outer suction tube 7 projections are avoided.

In the exemplary embodiment shown in FIG. 1, the suction channel 8 runs completely inside of the jacket channel 6 and over its entire length does not have any openings through which secondary air can travel into the suction channel 8. The suction channel 8 only has a respective opening at each of its outer ends via which a connection to further tube or hose systems can take place. The transition region of the suction channel 8 between the inner suction tube 4 and outer suction tube 7 is provided with a seal so that secondary air cannot travel into the suction channel 8 at this contact site.

The telescoping tube system 1 shown in FIG. 1, the end of the inner suction tube 4 facing away from the outer suction tube 7 has a socket piece 9 as a first connection element, and the end of the outer suction tube 7 facing away from the inner suction tube 4*a* has a connecting sleeve 10 as a second connection element. A detailed representation of the socket piece 9 is shown in FIG. 2 and a detailed representation of the connecting sleeve 10 is shown in FIG. 3.

Figure 2:
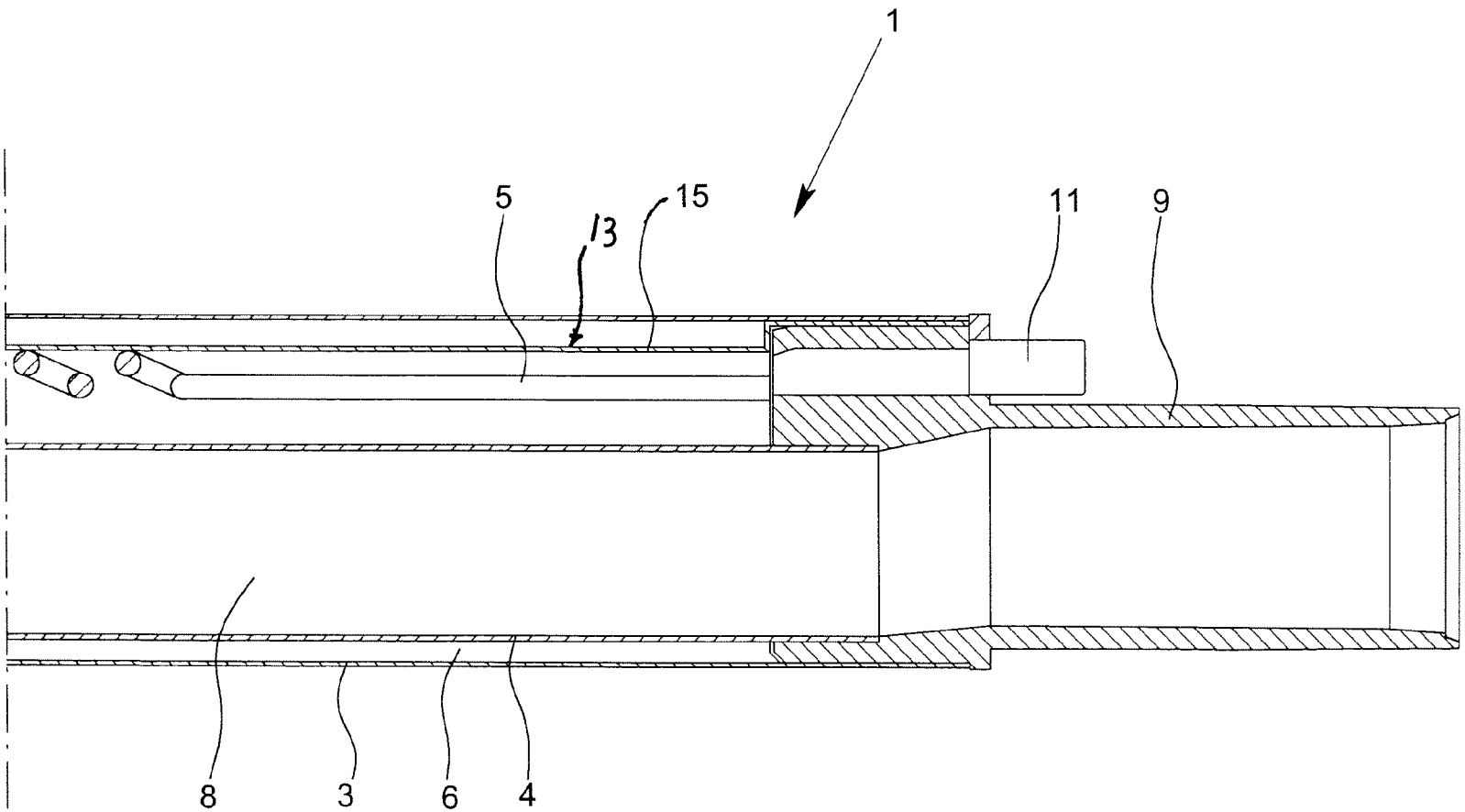
FIG. 2 is a sectional view of a first end region of the embodiment shown in FIG. 1.

FIG. 2 shows the socket piece 9 located at right in FIG. 1. The socket piece 9 in this exemplary embodiment is connected positively to the inner suction tube 4 and constitutes an extension of the suction channel 8. The socket piece 9 is partially inserted into the outer jacket tube 3 and is also positively connected to the outer jacket tube 3 so that the inner suction tube 4 on this first end of the telescoping tube system 1, shown in FIG. 2, is connected to the outer jacket tube 3 via the socket piece 9. In the upper region of the socket piece 9, the first end of the cable 5 is attached to the socket piece 9, the cable on this end having a plug 11 and a mechanical connection of the cable 5 to the socket piece 9 being produced by way of the plug 11. The cable 5 and the suction channel 8 run next to one another inside of the jacket channel 6.

Figure 3:
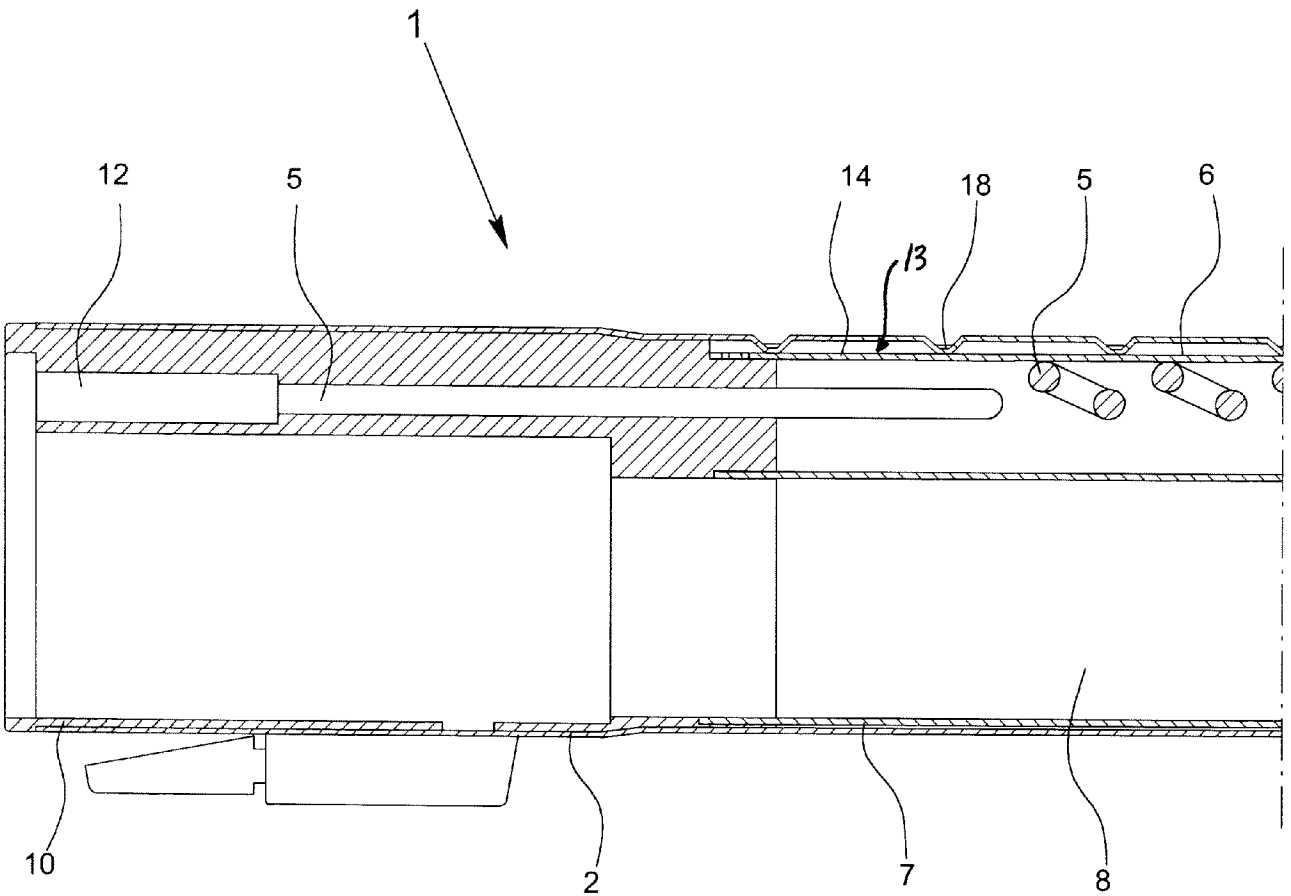
FIG. 3 is a sectional view of a second end region of the embodiment shown in FIG. 1.

FIG. 3 shows a detailed representation of the socket piece 10 shown at left in FIG. 1. The socket piece 10 is positively connected to the outer suction tube 7. The socket piece 10 is inserted almost completely into the inner jacket tube 2 so that the socket piece 10 is also positively connected to the inner jacket tube 2. The socket piece 10, consequently, establishes a connection between the outer suction tube 7 and the inner suction tube 2 so that the outer suction tube 7 on the end of the telescoping tube system 1 shown in FIG. 3 is connected to the inner jacket tube 2 by way of the socket piece 10. The socket piece 10 has a guide for the cable 5 in its upper region, the cable 5 on this end being attached to the socket piece 10 and having a socket 12. The socket 12 is located in the socket piece 10 such that the socket piece 10 and the socket 12 end flush on the second end of the telescoping tube system 1 and fill the cross section of the inner jacket tube 2.

Figure 5:
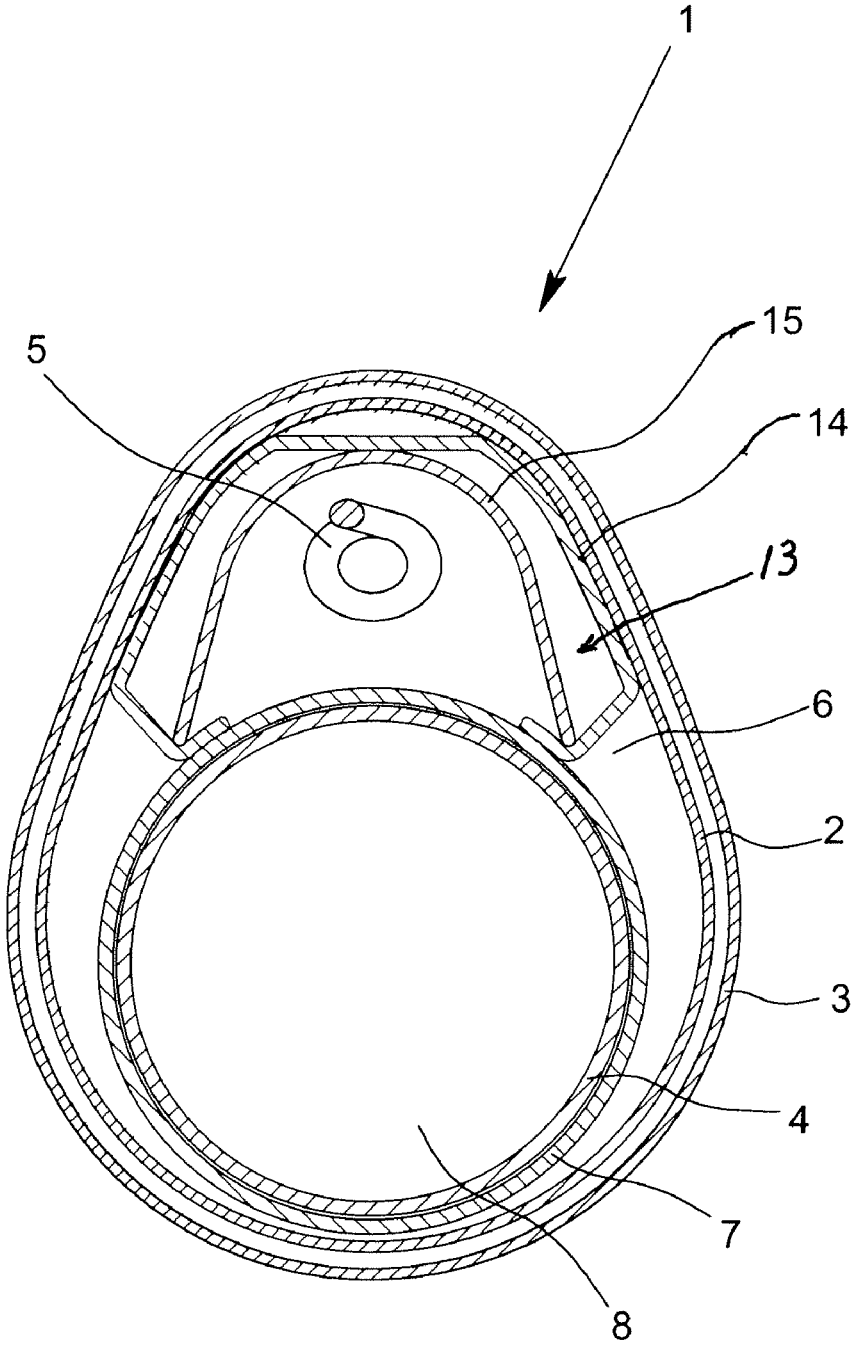
FIG. 5 is a cross-sectional view of the exemplary embodiment taken along line A-A in FIG. 1.

In order to cover the cable 5 relative to the outer jacket tube 3 and the inner jacket tube 2, in this exemplary embodiment, as shown in FIGS. 1 to 3, there is a two-part shell 13, the shell 13 comprising a first shell element 14 and a second shell element 15, most clearly seen in FIG. 5. The shell 13, in the same manner as the jacket channel 6 and the suction channel 8, is able to telescope due to the two shell elements 14, 15. So that simultaneous telescoping of the shell 13 with the jacket channel 6 and the suction channel 8 is possible, the first shell element 14 is attached to the socket piece 10. The first shell element 14 overlaps the second shell element 15 at least in part so that the second shell element 15 can be moved within the first shell element 14 of the shell 13. In order to ensure a telescoping capacity of the shell 13, the second shell element 15—shown in FIG. 2—is attached to the socket piece 9.

Figure 4:
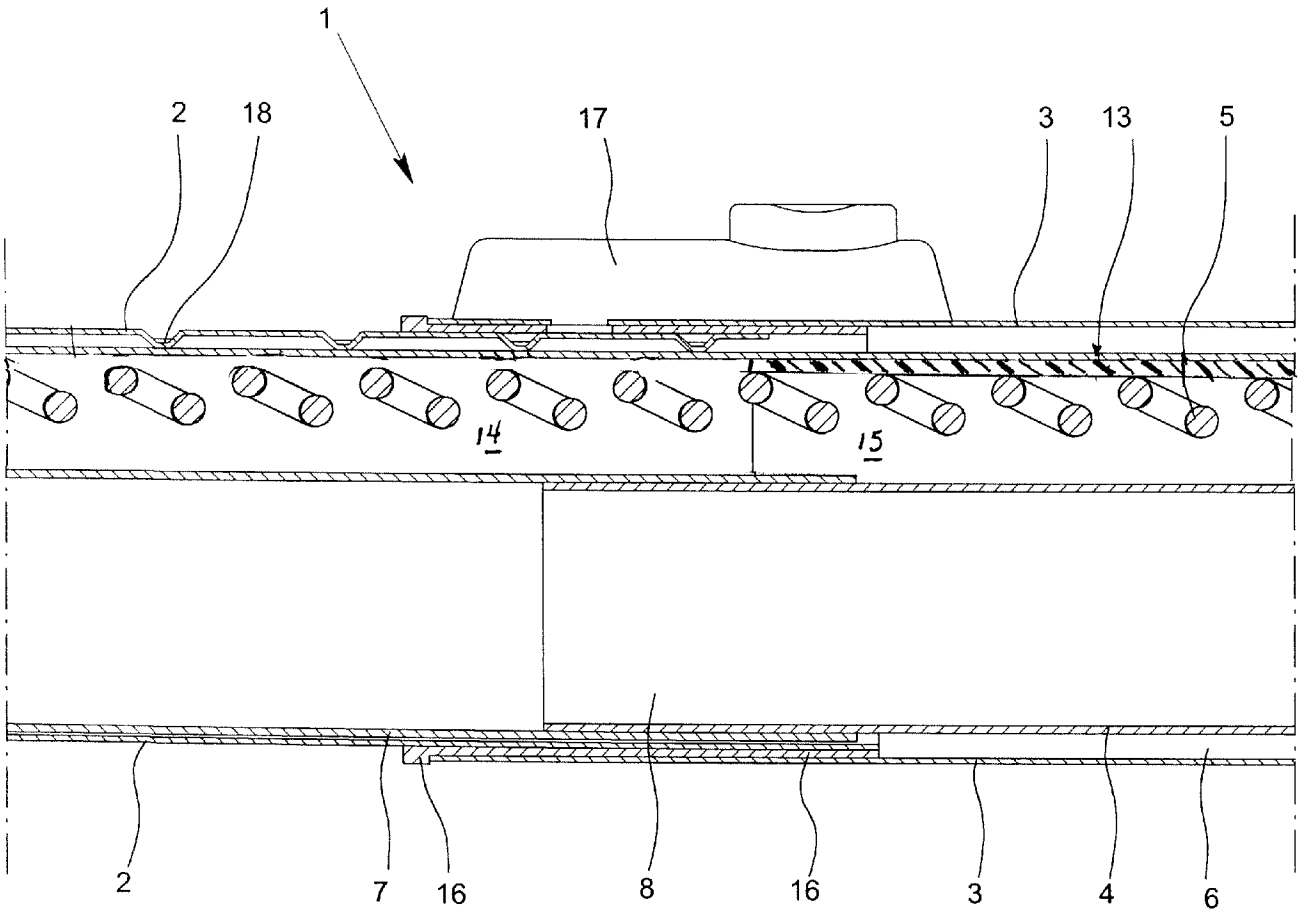
FIG. 4 is a sectional view of a middle region of the embodiment shown in FIG. 1.

FIG. 4 shows a detailed representation of the middle region of the telescoping tube system 1 according to the exemplary embodiment in FIG. 1. The illustrated middle region indicates how the inner suction tube 4 has been inserted into the outer suction tube 7. The cable 5, which is made as a helical cable in this exemplary embodiment, runs above the suction channel 8 formed by the inner suction tube 4 and the outer suction tube 7. The cable 5 is reliably covered relative to the inner jacket tube 2 and the outer jacket tube 3 over their entire length by the shell 13 which is formed of the first shell element 14—shown at left in FIG. 4—and the second shell element 15—shown at right in FIG. 4.

On the middle region shown in FIG. 4 a spacer 16 is placed between the outer jacket tube 3 and the inner jacket tube 2, the spacer 16 being used to define the distance between the outer jacket tube 3 and the inner jacket tube 2 and to ensure sealing of the connecting site. In addition, the spacer 16 is connected to an interlocking device 17, the interlocking device 17 being made such that it can be positively connected to catch recesses 18 provided in the inner jacket tube 2 so that a connection is established between the inner jacket tube 2 and the outer jacket tube 3 which ensures fixing of the tubes 2, 3 relative to one another and prevents movement of the inner jacket tube 2 relative to the outer jacket tube 3. The length of the jacket channel 6 can be established and fixed by way of this interlocking device 17; adjustment takes place incrementally depending on the distances between the catch recesses 18 in the inner jacket tube 2.

FIG. 5 shows a cross section of the exemplary embodiment in FIG. 1 perpendicular to the tube axis along line A-A of FIG. 1. The inner suction tube 4 is located at least partially in the outer suction tube 7 so that the inner suction tube 8 with the outer suction tube 7 forms the suction channel 8. The suction channel 8 is located within the jacket channel 6, the jacket channel 6 being formed by the inner jacket tube 2 and the outer jacket tube 3. Above the suction channel 8, within the jacket channel 6, the cable 5 runs next to the suction channel 8. The cable 5 is covered relative to the inner jacket tube 2 and the outer jacket tube 3 along the entire length within the jacket channel 6 by the U-shaped shell 13. For this purpose, the first element 14 of the shell 13 is supported on the outside surface of the outer suction tube 7 or of the inner suction tube 4. In the mutual intersection region, the first shell element 14 overlaps the second shell element 15.

The inner suction tube 4, the outer suction tube 7, the first element 14 and the second element 15 are made of plastic so that even when the immediate insulation of the cable 5 is damaged, electrically insulating covering relative to all metallic parts is ensured. The outer jacket tube 3 and the inner jacket tube 2 are made of metal in this exemplary embodiment.

The representation in FIG. 5 comprises only those parts which are in fact in the plane of the section. The description of further components, such as, for example, the socket piece 9, catch recesses 18 and the interlocking device 17, has been omitted in FIG. 5 for reasons of clarity of the drawing.

What is claimed is:

1. Telescoping tube system for a vacuum cleaner, comprising:

an inner jacket tube, an outer jacket tube, an inner suction tube, an outer suction tube, and a cable, wherein the inner jacket tube has a smaller cross section than the outer jacket tube, the inner jacket tube being connected to the outer jacket tube so as to form a telescoping jacket channel, wherein the inner suction tube is located in the jacket channel, wherein the cable is guided within the jacket channel outside the inner suction tube, wherein the outer suction tube and the inner suction tube form an essentially closed suction channel within the jacket channel; and wherein a first connection element is provided on an end of the inner suction tube facing away from the outer suction tube and there is a second connection element on an end of the outer suction tube facing away from the inner suction tube, and wherein the inner suction tube is connected to the outer jacket tube by way of the first connection element and the outer suction tube is connected to the inner jacket tube by way of the second connection element.

2. Telescoping tube system as claimed in claim 1, wherein the length of the suction channel always corresponds essentially to the length of the jacket channel.

3. Telescoping tube system as claimed in claim 1, wherein the suction tubes are free of any openings through which secondary air can enter the suction channel.

4. Telescoping tube system as claimed in claim 1, wherein the suction channel has an essentially round cross section.

5. Telescoping tube system as claimed in claim 1, wherein the first connection element is a socket piece and the second connection element is a connecting sleeve, the connecting sleeve at least partially into the inner jacket tube and the socket piece being inserted at least partially into the outer jacket tube.

6. Telescoping tube system as claimed in claim 1, wherein the cable and the suction channel run next to one another within the jacket channel.

7. Telescoping tube system as claimed in claim 1 wherein a first end of the cable is attached to the first connection element and a second end of the cable is attached to the second connection element.

8. Telescoping tube system as claimed in claim 1, wherein a socket is provided on one end of the cable and a plug being provided on an opposite end of the cable, the socket being positively attached to one of the first connection element and the second connection element and the plug being positively attached to other of the first connection element and the second connection element.

9. Telescoping tube system as claimed in claim 1, further comprising a shell which covers the cable relative to the outer jacket tube and the inner jacket tube.

10. Telescoping tube system as claimed in claim 9, wherein the shell comprises at least one first shell element and a second shell element, the first shell element and the second shell element being telescopically connected together.

11. Telescoping tube system as claimed in claim 1, wherein the suction tubes comprise vacuum cleaner tubes.

12. Telescoping tube system for a vacuum cleaner, comprising:

an inner jacket tube, an outer jacket tube, an inner suction tube, an outer suction tube, and a cable, wherein the inner jacket tube has a smaller cross section than the outer jacket tube, the inner jacket tube being connected to the outer jacket tube so as to form a telescoping jacket channel, wherein the inner suction tube is located in the jacket channel, wherein the cable is guided within the jacket channel outside the inner suction tube, wherein the outer suction tube and the inner suction tube foam an essentially closed suction channel within the jacket channel;

further comprising a shell which covers the cable relative to the outer jacket tube and the inner jacket tube, wherein the shell comprises at least one first shell element and a second shell element, the first shell element and the second shell element being telescopically connected together, and wherein a first connection element is provided on an end of the inner suction tube facing away from the outer suction tube and there is a second connection element on an end of the outer suction tube facing away from the inner suction tube, the inner suction tube being connected to the outer jacket tube by way of the first connection element and the outer suction tube being connected to the inner jacket tube by way of the second connection element, and wherein the first shell element is attached to the second connection element and the second shell element is attached to the first connection element.

13. Telescoping tube system as claimed in claim 12, wherein the shell elements are made of a plastic.

14. Telescoping tube system as claimed in claim 13, the first shell element is made of Polyethylene (PE) and the second shell element is made of Polyethylene Terephthalate (PET).

15. Telescoping tube system as claimed in claim 12, wherein a sealing device is provided on the inner suction tube.

16. Telescoping tube system as claimed in claim 12, wherein a spacer is provided between the outer jacket tube and the inner jacket tube, an interlocking device being provided on the spacer, and wherein the outer jacket tube is fixable relative to the inner jacket tube in various positions by the interlocking device.

* * * * *